US005282544A

United States Patent [19]

Boots

[11] Patent Number: 5,282,544

[45] Date of Patent: Feb. 1, 1994

[54] CONTAINER FOR BULK MATERIALS AND FLUIDS

[76] Inventor: Gerardus A. M. Boots, J. Kruyverstraat 26, 1507 WH, Zaandam, Netherlands

[21] Appl. No.: 794,073

[22] Filed: Nov. 19, 1991

[30] Foreign Application Priority Data

Nov. 19, 1990 [NL] Netherlands ..... 9002520

[51] Int. Cl.[5] ..... B65D 90/04

[52] U.S. Cl. ..... 220/403; 220/404; 220/666; 220/650; 383/40; 229/920

[58] Field of Search ..... 220/403, 404, 407, 666; 383/650, 140; 229/920

[56] References Cited

U.S. PATENT DOCUMENTS 3,272,423 9/1966 Bjarno .

FOREIGN PATENT DOCUMENTS 0247696 12/1987 European Pat. Off. .
0276878 3/1988 European Pat. Off. .
0401934 12/1990 European Pat. Off. .
0446695 9/1991 European Pat. Off. .
1246850 10/1960 France .
2267255 11/1975 France .
03558 6/1987 PCT Int'l Appl. .
1287082 8/1972 United Kingdom .

*Primary Examiner*—Joseph Man-fu Moy

[57] ABSTRACT

A container for bulk materials, fluids and the like, comprising an enveloping member and an inner member which is connected to the enveloping member at at least four positions spaced along the circumference of the enveloping member, the arrangement being such that in filled condition a substantially block-shaped unit with substantially flat walls is obtained, the container further comprising a U-shaped stiffening member which comprises a web and two legs connecting thereto and is made of a material with a stiffness of its own, arranged so that the legs abut two opposite walls of the block-shaped unit and the web abuts the bottom wall of the block-shaped unit, the legs, at least in the areas adjacent their free upper edge, having a width corresponding substantially to that of the adjacent wall of the block-shaped unit and the U-shaped stiffening member being connected to the enveloping member at least in the areas referred to.

16 Claims, 3 Drawing Sheets

CONTAINER FOR BULK MATERIALS AND FLUIDS

This invention relates to a container for bulk materials, fluids and the like, comprising an enveloping member and an inner member which is connected to the enveloping member at at least four positions spaced along the circumference of the enveloping member, at least one of the members having a length equal to the height of the container to be formed and the other member having a length of at least 30% of the height referred to, the arrangement being such that in filled condition a substantially block-shaped unit with substantially flat walls is obtained.

Such a package is known from EP-A-0 247 696 or EP-A-0 276 878. The major advantages of such a container reside in the accuracy with which its outer dimensions can be determined beforehand and the flatness of the walls obtained in the filled condition of the container, i.e. in filled condition the walls do not bulge but remain straight. These particular properties are the result of the use of the inner member which assumes a substantially cylindrical form in the filled condition and retains the enveloping member fixed to it. The enveloping member forms four ear-shaped compartments so as to modify the circular form of the inner member (viewed in horizontal cross-section) into a substantially square or rectangular shape. The material of which the container is made can be selected from the entire range of materials used for containers, i.e. materials with as well as without a stiffness of their own. In all cases, the container obtained in filled condition has substantially straight walls and exhibits high stacking strength, which is also a result of the use of the inner member having a substantially cylindrical form in filled condition.

If the container is made of a material having a low or minor stiffness of its own, it may happen that for instance mass inertia forces in horizontal direction reduce the stability of the filled container in that direction. This means that when a vehicle transporting the filled containers accelerates or decelerates, the containers may become vertically misaligned, which is especially disadvantageous if the containers contain large masses or have large dimensions. US-A-3 272 423 discloses a container consisting of an inner bag of relatively weak material and a tubular member made of a relatively rigid and strong material shielding the upper and the lower wall as well as two sidewalls of the inner bag when the inner bag is filled with the material to be packaged. The inner bag and the tubular member form a unit in that the inner bag's shielded sidewalls are fixedly connected to the adjacent surfaces of the tubular member. The inner bag's shielded sidewalls are slightly narrower than the adjacent surfaces of the tubular member, so that the corners of the inner bag are disposed within the tubular member in retracted and hence protected position. Thus, it is possible to provide a consumer container for food while saving material by omitting the sidewalls and simplifying the blank for the tubular member to a rectangular shape. However, such a container will easily bulge and present problems regarding stability particularly if larger amounts of material are to packaged.

It is an object of this invention to improve the stability in horizontal direction in a container of the type described in the preamble.

This is achieved in accordance with the invention by using a U-shaped stiffening member which comprises a web and two legs connecting thereto and is made of a material with a stiffness of its own, arranged so that the legs abut two opposite walls of the block-shaped unit and the web abuts the wall connecting said two walls and forming the bottom wall of the block-shaped unit in the operative position, the legs, at least in the areas adjacent their free upper edge, having a width corresponding substantially to that of the adjacent wall of the block-shaped unit and the U-shaped stiffening member being connected to the enveloping member at least in the areas referred to.

By virtue of these features, the stability of the container in the filled condition is increased considerably. The upper edges of the container are retained by the upper edge areas of the legs of the U-shaped stiffening member, while these legs, which are made of a material with a stiffness of its own, are held in position by the web of the U-shaped stiffening member, which in turn cannot move because the full weight of the filled container bears on it.

It is noted that the connection between the legs and the enveloping member may extend throughout the entire height of the container, but not necessarily so. The material disposed in the upper part of the container is most susceptible to displacement by horizontal forces. The material further down is pressed into position by the superjacent material. Thus, it is sufficient to connect the legs and the enveloping member only in their upper areas, which also means that outside these areas the U-shaped stiffening member may be considerably narrower than the width of the adjacent parts of the container.

Connecting the U-shaped stiffening member to the enveloping member can be effected in many ways, for instance by means of a strip of material which is connected to the enveloping member at two points, in such a way that an insertion opening for a leg is formed. Another option is a mechanical connection by means of staples, clamps, or the like. However, it is preferable, and in accordance with a further embodiment of the invention, for the U-shaped stiffening member to be connected to said enveloping member in the areas referred to by means of a glued joint. In practice, it has been found that the forces acting on such a connection are such that, in accordance with a further preferred embodiment of the invention, it is sufficient to effect a glued joint by means of double-sided adhesive tape. This connecting material has the advantage that it permits the mutual connection of virtually any suitable materials, such as cardboard, paper, various plastics, wood, etc., in any combination.

If for the enveloping member a material is used with a low or minor stiffness of its own, the four ear-shaped compartments formed by the enveloping member, like the inner member, will assume a substantially circular cross-section, so that the filled enveloping member will have rounded corners. The connection between legs and envelope, however, should be provided in an area where contact between them is maintained even in the filled condition. Accordingly, the connection is provided at some distance from the lateral edges of the legs, unless, in accordance with a further embodiment of the invention, the legs comprise pivoting side panels at least throughout the height of the connection between the U-shaped stiffening member and the enveloping member, which side panels are capable of following a change in the shape of the enveloping member during filling of the container, the connection between the U-shaped stiffening member and the enveloping member being provided on a panel. Such an embodiment has the further advantage that during filling of the container, the side panels pivot inwardly, thereby further stiffening the U-shaped stiffening member.

To increase the stability of the container still further, it may be preferable, and in accordance with a further embodiment of the invention, to interconnect the two legs in their upper edge areas by means of a strip-shaped member which has a length equal to that of the web of the U-shaped stiffening member and is made of a material of lower stretch than the stretch of the material of which the enveloping member is made.

In this connection, a further preference is expressed for said strip-shaped member to be in the form of a panel of a height equal to the length of the legs, which panel is made of a material having a stiffness of its own. In this way, the open sides of the U-shaped stiffening member can be closed, which provides a protection of the enveloping member and/or the inner member against damage.

Such a protection can be realized in a relatively simple manner if, in accordance with a further embodiment of the invention, the panel is part of a box which, viewed in horizontal cross-section, has an inner contour of a length and width at least equal to the length of the web and the largest width of the legs of the U-shaped stiffening member. It is noted here that owing to its form-retaining ability, after being filled the container can without difficulty be slid into the box or be pulled from it prior to emptying.

Because in the filled condition of the container the packed material retains the web of the U-shaped stiffening member in its flat condition, it is possible, and in accordance with a further embodiment of the invention, to provide for the web to comprise a folding line halfway between the two legs. This has the advantage that in empty condition the U-shaped stiffening member with the envelope and inner member connected thereto can be folded into a flat shape.

To facilitate handling during filling and emptying, particularly in the case of voluminous containers, it is preferable, and in accordance with a further embodiment of the invention, that hoisting provisions, such as loops, are provided on the enveloping member and/or the inner member, that the folding line in the web is designed as a breakable connection, and that the enveloping member comprises a closable discharge aperture. When the container has been lifted via the hoisting provisions, it is easy to slide an enclosing box onto or off the container, as noted above. When a container is to be emptied and the box that may be present has been removed, the folding line in the web can be broken, thereby allowing access to the closable discharge aperture. After the container has been brought above a location where its contents are to be discharged and has been emptied via the discharge aperture, the discharge aperture can be closed again, the folding line can be restored again, for instance with tape, and the container is ready for reuse again.

Further advantageous use can be made of the fact that the U-shaped stiffening member is made of a material with a stiffness of its own by providing, in accordance with a further embodiment of the invention, for the panel to be extended at its lateral edges adjoining the edges of the leg so as to incorporate pivoting panel sections which are secured to the respective external surfaces of the legs, whereby each panel and the web halfway between the two legs are provided with a folding line and the web serves as bottom wall. Thus, the presence of the U-shaped stiffening member has been used advantageously to provide a box with a stiffness of its own surrounding the enveloping member while using a relatively small amount of additional material. The folding lines in the panels and the web enable the assembly to be folded into a flat configuration. It is noted here that the folding lines halfway the panels, which are extremely rare in the field of packaging, do not adversely affect stability owing to the form-retaining properties given to the container by the enveloping member and the inner member.

In a box so formed using the U-shaped stiffening member, a gap is present between the panel and the web adjacent the bottom surface. If it is considered desirable to close the gap, such can be easily effected if, in accordance with a further embodiment of the invention, a panel is extended along its longitudinal edge which is adjacent a lateral edge of the web in the filled condition of the container, to incorporate a pivoting strip member which can be pivoted against the web in the filled condition of the container.

It has already been noted that when pivoting side panels are provided on the legs of the U-shaped stiffening member, a further stiffening effect arises during filling of the container in that said side panels pivot inwardly. If an enclosing box is present—whether or not using the U-shaped stiffening member—advantageous use can be made of the compartments formed in the corners of the box for further increasing the stacking strength of the box, if, in accordance with a further embodiment of the invention, a stiff rod-shaped element is arranged in each corner formed by a leg and a panel, which element extends throughout the height of the container and preferably has a triangular cross-section.

To provide for a mutual connection of the legs of the U-shaped stiffening member, it is also possible, and in accordance with a further embodiment of the invention, that the strip-shaped member forms the wall of a trough of stiff material, such as wood, which trough, viewed in horizontal cross-section, has an inner contour of a length and width at least equal to the length of the web and the largest width of the legs of the U-shaped stiffening member. As noted above, owing to its inherent form retaining ability, the container can be slid into and out of such a trough. This can be used to advantage by securing the trough to a pallet, which provides for a reliable coupling with the pallet as well as a stiffening effect. The container could further be covered at the top with a similar trough.

Another way of coupling a container to a pallet can be obtained if, in accordance with a further embodiment of the invention, to allow the enveloping member with inner member to be secured to the U-shaped stiffening member, this stiffening member is inserted in two slots provided on opposite sides of a pallet, with the bottom face of each slot being in alignment with the bearing surface of the pallet and the slots being positioned relative to each other in such a manner that the legs of the U-shaped stiffening member can be brought into a position where they extend vertically relative to the bearing surface of the pallet.

The container according to the invention will now be further discussed and elucidated, by way of example, with reference to the embodiments shown in the accompanying drawings, in which.

Figure 1:
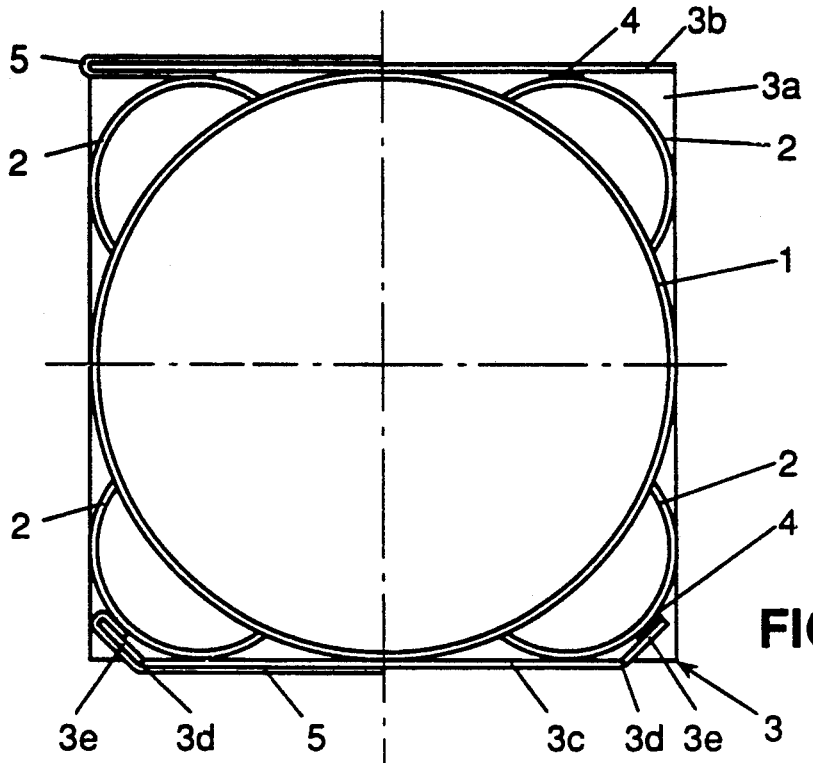
FIG. 1 is a top plan view of a container in filled condition, showing a different design in each quadrant.

FIG. 1 shows a container comprising an inner member 1 and an enveloping member 2, which will generally consist of a continuous piece of material rather than four separate parts. The material of which the two members are made can be any desired and suitable packaging material, for instance plastics, paper, cardboard, ribbon-web material, or any other material which can assume the configuration shown in FIG. 1 when filled with bulk materials, fluids or the like. The cylindrical forms are particularly stable in shape, so that after filling an accurately defined circumference is obtained which is maintained also when, for instance, a number of such filled containers are stacked on top of each other. To provide for a proper filling up of the container, the inner member may have a smaller height than the enveloping member or comprise one or more interruptions adjacent the crescent or ear-shaped pockets of the enveloping member.

As noted, the container has a high form-retaining ability, also when stacked, i.e. bulges will hardly occur, if at all. However, the stability of the container may be affected by horizontal forces, for instance mass inertia forces during transit, particularly if large containers are involved. To increase this stability, use is made of a U-shaped stiffening member 3 comprising a web 3*a* and two legs 3*b* and 3*c* which are connected to the enveloping member 2, for instance by means of tape 4, as shown in the right-hand part of FIG. 1, or by means of a strip of material 5, as shown in the left-hand part of FIG. 1. A glued joint other than tape 4 can be chosen, and the strip 5 may be glued, rather than welded, to the enveloping member 2. The strip 5 as shown in FIG. 1 is to be conceived of as mirror-symmetrically doubled, so that a receiving opening is formed for sliding a leg 3*b* or 3*c* therein. The connection referred to can also be realised in any other way, for instance by means of staples or clamps.

To maintain the connection in the desired manner both in the empty and in the filled condition, the tape 4 must be provided at a point where there is continuous contact between a leg and the envelope. As appears from the upper right-hand quadrant of FIG. 1, this may mean that the connection referred to is provided at some distance from a corner. It is stressed here that the shape and dimensions of inner member 1 and enveloping member 2 are merely examples and can be varied in many different ways, as laid down by the present inventor in a number of previous applications. If it is desired that the connection between envelope and leg be closer to the corner of the envelope, such can be done by opting for the embodiment shown in the lower right-hand quadrant of FIG. 1, where the leg 3*c* adjacent its lateral edge comprises a side panel 3*e* pivotable about a folding line 3*d*, said panel 3*e* having provided thereon the tape 4 forming the connection between the envelope and the leg. By virtue of this construction, that connection can follow a settling motion of the enveloping member 2 during filling.

The use of the U-shaped stiffening member 3 improves stability in that horizontal forces through the connection referred to are taken up by legs 3*b* and 3*c* which in turn are retained in position by web 3*a*, which maintains its flat position owing to the weight of the contents of the inner member 1 and the enveloping member 2 bearing thereon. It is noted that a construction with a pivoting side panel 3*e* increases the stiffness of the U-shaped stiffening member 3 still further by pivoting into the position shown in FIG. 1. As shown in the lower left quadrant of FIG. 1, a side panel 3*e* pivoting about a folding line 3*d* can also be opted for when a strip 5 is used.

Figure 2:
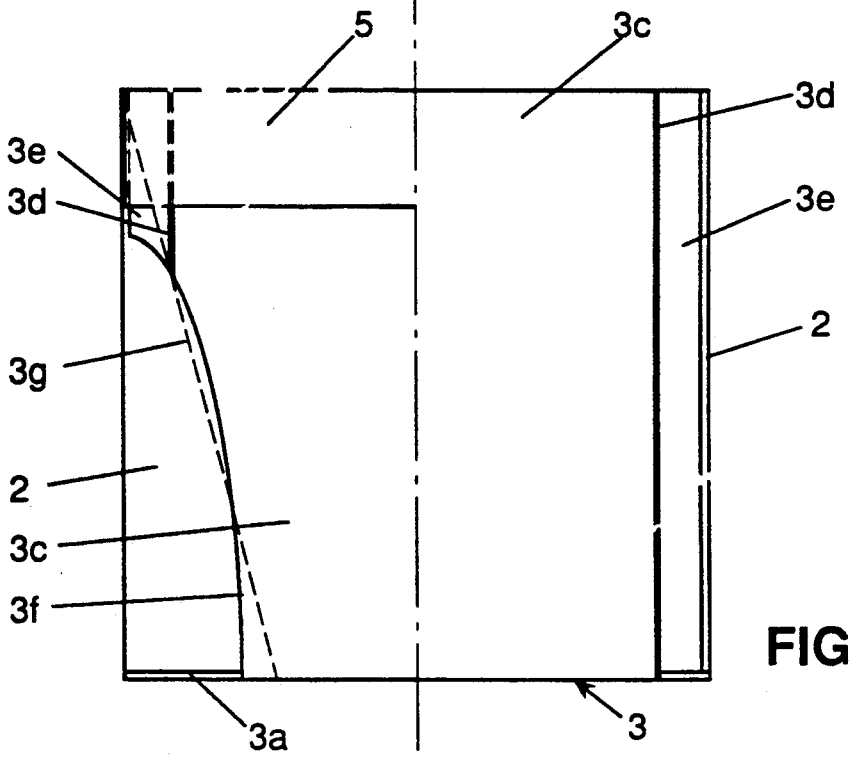
FIG. 2 is an elevation of the container according to FIG. 1, in which different designs are shown on the left and the right.

As stated, the increased stability is due to the legs 3*b* and 3*c* retaining the enveloping member 2 when horizontal forces are being exerted. Especially the upper part of the packaged material will be susceptible to displacement in horizontal direction as a result of such forces. This means that a good result can be obtained if only the area of the upper edge of envelope 2 is retained in position by the legs 3*b* and 3*c*. Accordingly, a leg need not have the same width throughout its height but may be narrower under the upper edge area as indicated by the line 3*f* in the left-hand part of FIG. 2. In that case, the pivoting side panel 3*e* has a limited length. For that matter, the leg may also have continuously decreasing dimensions in transverse direction, as indicated by the broken line 3*g*. It is further noted that the width of the web 3*a* may be equal to that of the leg at the point where they join. There are countless other variants. Thus, apertures can be provided in the legs, serving as grips for handling the container.

Figure 3:
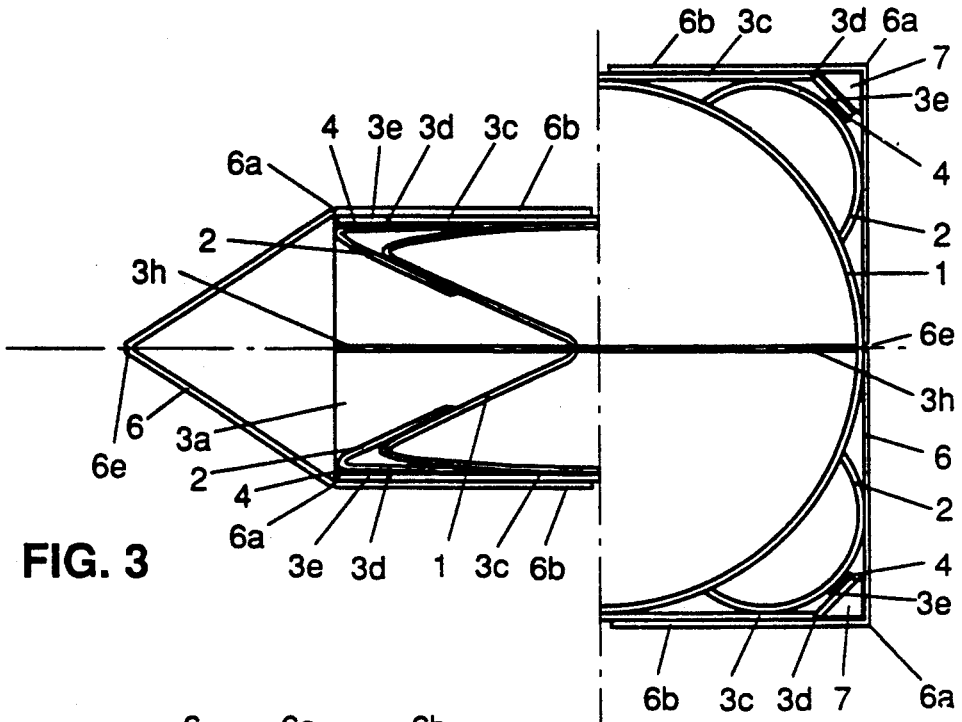
FIG. 3 is a top plan view of a further embodiment of the container, showing a semi-collapsed position on the left-hand side and the filled position on the right-hand side.

FIG. 3 shows a container such as in the lower right-hand quadrant of FIG. 1. Accordingly, like parts are indicated by like reference characters. To increase stability still further, the legs 3*c* are interconnected by means of a panel 6 having a width equal to the length of the web 3*a* and a height equal to that of a leg 3*c*. A side flap 6*b* is provided on opposite sides for pivoting movement about a folding line 6*a*, which side flap 6*b* is glued to the leg 3*c*. Thus, a box is obtained, open at the top and surrounding the enveloping member 2 and the inner member 1. In the erect position of the box, there is an open gap between the lower edge of the panel 6 and the web 3*a*, which gap can optionally be covered with a lower flap 6*d*, connected to panel 6 and pivotable about a folding line 6*c*. It need not be explained that a cover for the open box can be realized in similar manner, though naturally a separate cover can be used as well for that purpose.

In the erect position, the side panels 3*e* are pivoted inwardly, as explained hereinabove. As a result, in the corner areas an open space is formed bounded by the side panel 3*e*, the panel 6 and the side flap 6*b*. This open space can be advantageously used for inserting a rod-shaped element, for instance a wooden rod 7 of triangular cross-section, whereby the stacking strength can be increased still further.

Figure 4:
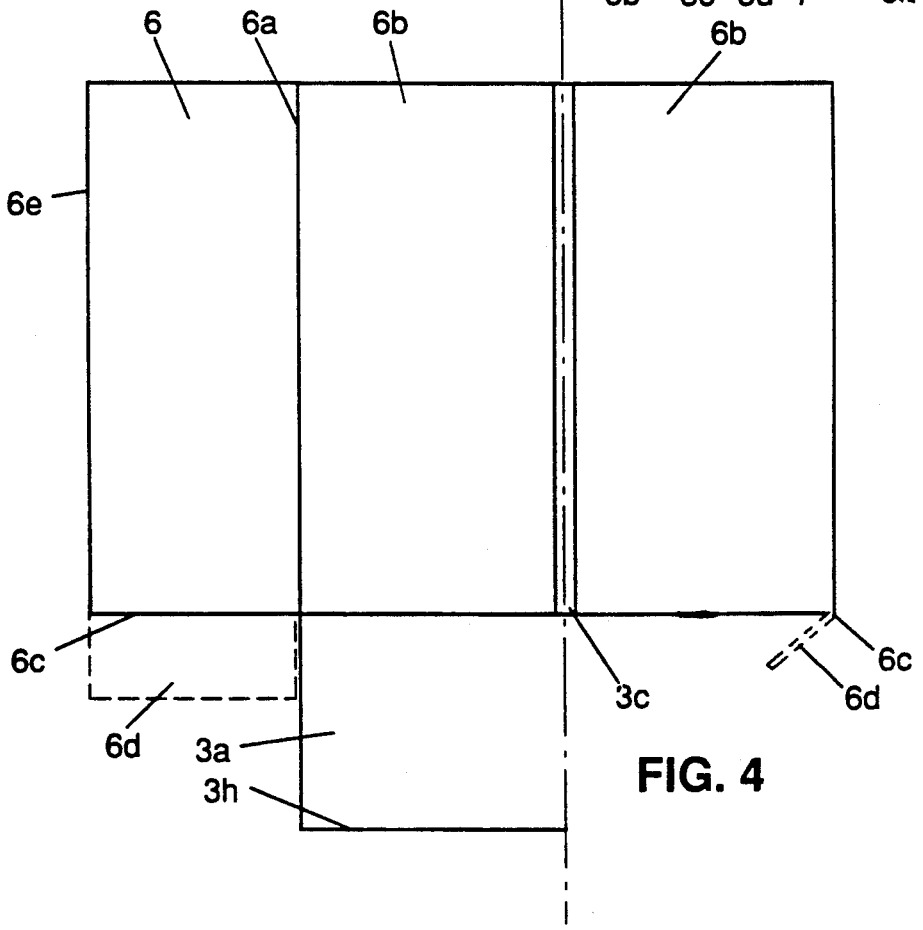
FIG. 4 is an elevation of the container similar to FIG. 3, again showing two different positions.

To collapse the container from the erect position shown in the right-hand part of FIG. 3 into a flat folded position, folding lines 6e are provided halfway the panels 6 and a folding line 3h halfway the web. The construction can then be folded like an accordion, an intermediate position being shown in the left-hand part of FIGS. 3 and 4.

Figure 5:
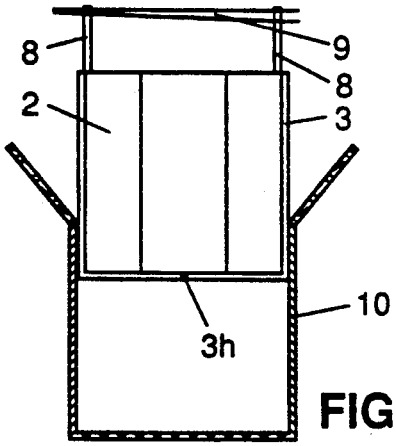
FIG. 5 shows a further variant of the container while being fitted into or removed from a box.
Figure 6:
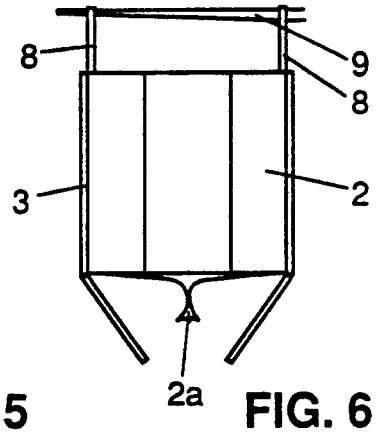
FIG. 6 shows the container according to FIG. 5 in a position to be emptied via its underside.

FIG. 5 shows a container comprising an enveloping member 2 with a U-shaped stiffening member 3 attached thereto. The high form-retaining ability and stability of the construction permit the container in the filled condition to be slid into or out of a separate enclosing box. To facilitate this, hoisting provisions in the form of loops 8 are attached to the enveloping member 2. Thus, the container can be lifted for instance by the prongs 9 of a forklift truck, whereupon the box 10 can be removed by sliding it downwards. Emptying the container can then be effected in a particularly appropriate manner if the folding line 3h referred to can be broken and the enveloping member comprises a discharge aperture 2a provided in its bottom. FIG. 6 shows the situation after the folding line 3h has been broken. The discharge aperture 2a has become accessible so that the container can be emptied in simple manner. When the discharge aperture 2a is closed again after emptying and the folding line 3h is subsequently restored, for instance by means of tape, the container is ready for reuse.

Figure 7:
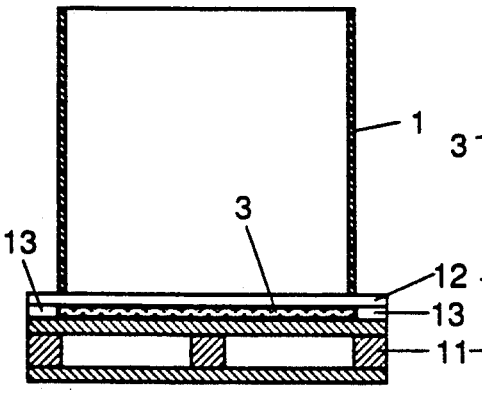
FIG. 7 is a section of yet another variant of the container arranged on a pallet.
Figure 8:
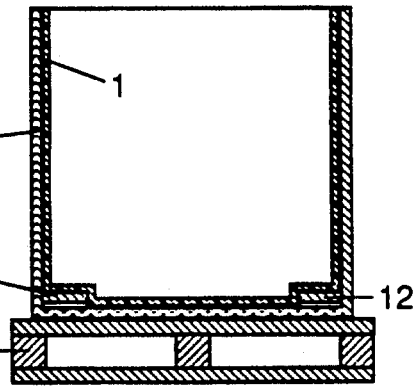
FIG. 8 is a section taken on line VIII—VIII of FIG. 7.

FIG. 7 shows a variant embodiment in which the container is coupled to a pallet 11 by means of the U-shaped stiffening member 3. For that purpose, adjacent two opposite lateral edges of the pallet 11, this pallet 11 is provided with an insertion gap for the U-shaped stiffening member 3. The two insertion gaps are formed by a plank 12 which is retained in spaced position relative to the carrying surface of the pallet 11 by means of chocks 13. The distance between the outer sides of the planks is equal to or slightly smaller than the length of the web of the U-shaped stiffening member 3. For coupling the container to the pallet, one of the legs of the U-shaped stiffening member 3 is inserted into one of the gaps, slid over the carrying surface and through the other insertion gap, until the two legs can be pivoted vertically upwards along the outsides of the planks 12. Then the enveloping member 2 with inner member 1 is arranged and secured to the U-shaped stiffening member 3, whereafter the container can be filled up while coupled to the pallet 11.

Figure 9:
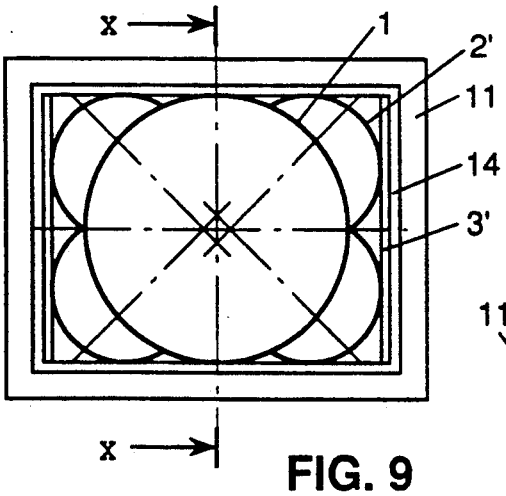
FIG. 9 is a top plan view of still a further variant of the container.
Figure 10:
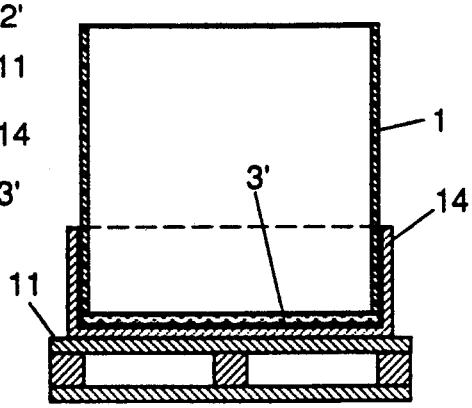
FIG. 10 is a section taken on line X—X of FIG. 9.

FIGS. 9 and 10 show a different way of connecting a container to a pallet 11. It is noted that it appears from FIG. 9 that the inner member 1 and enveloping member 2' are shaped somewhat differently, so that a container of rectangular cross-section is obtained, which has the same form-retaining properties as for instance the square container shown in FIG. 1. The stability of this container has also been increased by means of a U-shaped stiffening member 3', which is connected to the enveloping member 2' in one of the ways discussed above. Mounted on the pallet 11 is a trough 14, made of wood, for instance, having inside dimensions corresponding to the outer circumferential dimensions of the container. Owing to its form-retaining ability, the container in the filled condition can be slid into and out of the trough 14, if desired. If the dimensions of the trough 14 are chosen to be slightly smaller than those of the container, the container must be arranged in the trough before it is filled and upon being filled it will be wedged in the trough 14.

It goes without saying that within the framework of the invention, many modifications and variants are possible. The above discussion of the different variants in respect of various embodiments is not to be considered exhaustive. Thus, the panel used for coupling the two legs can also be seen as a sidewall of a box. Such a coupling can also be effected by means of a strip of material of lesser height than the height of the container. For a proper operation it is then desirable for the strip to be made of a material of lower stretch than that of the material of which the enveloping member is made. In the embodiment according to FIG. 3, rods 7 have been inserted in the spaces formed as a result of the pivoting motion of the side panels 3e. These rods could also be fixedly attached to a pallet, the form-retaining ability of a filled container permitting it to be slid onto those rods in the manner as shown for instance in FIG. 5.

I claim:

1. A combination of a container for bulk materials and fluids with a U-shaped stiffening member, the container comprising an enveloping member and an inner flexible member, the enveloping member comprising a plurality of ear-shaped compartments connected to an outer surface of the inner member at at least four positions spaced along the outer circumference of the inner member, the arrangement being such that in a filled condition, the container obtains the shape of a substantially block-shaped unit with substantially flat walls, the U-shaped stiffening member being formed of a stiff material and comprising a web and two legs connected thereto, the stiffening member being arranged so that at least an upper portion of each leg abuts one of two opposite side walls of the block-shaped unit via said ear-shaped compartments, and the web abuts a wall connecting said two side walls and forming a bottom wall of the block-shaped unit in an operative position, the upper portion of the legs having a width corresponding substantially to that of the abutting side wall of the block-shaped unit so that bulging is prevented in the legs of the stiffening member.

2. A container according to claim 1, characterized in that the U-shaped stiffening member is connected to the enveloping member in said areas by means of a glued joint.

3. A container according to claim 2, characterized in that the glued joint consists of double-sided adhesive tape.

4. A container according to any one of the preceding claims, characterized in that the legs, at least throughout the height of the connection between the U-shaped stiffening member and the enveloping member, comprise pivoting side panels which can follow a change in the shape of the enveloping member occurring during the filling of the container, the connection between the U-shaped stiffening member and the enveloping member being disposed on a panel.

5. A container according to any one of claims 1-3, characterized in that a lateral edge of a leg is connected to the lateral edge of the other leg on the same side of the U-shaped stiffening member, which connection is formed by a strip-shaped member which has a length equal to that of the web of the U-shaped stiffening member and is made of a material having a stretch that is lower than the stretch of the material of which the enveloping member is made.

6. A container according to claim 4, characterized in that a side edge area of the leg, which is disposed inwardly of the pivoting panel is connected to a side edge area of the other leg, disposed on the same side of the U-shaped stiffening member and likewise disposed inwardly of the pivoting side panel, which connection is formed by a strip-shaped member which has a length equal to that of the web of the U-shaped stiffening member and is made of a material having a stretch that is lower than the stretch of the material of which the enveloping member is made.

7. A container according to claim 6, characterized in that said strip-shaped member is in the form of a panel having a height equal to the length of the legs, which panel is made of a material having a stiffness of its own.

8. A container according to claim 7, characterized in that the panel is part of a box which, viewed in horizontal cross-section, has an inner contour with a length and width at least equal to the length of the web and the largest width of the legs of the U-shaped stiffening member.

9. A container according to claim 8, characterized in that the web is provided with a folding line halfway between the two legs.

10. A container according to claim 9, characterized in that hoisting provisions, such as loops, are attached to the the enveloping member and/or the inner member, that the folding line in the web is designed as a breakable connection and that the enveloping member comprises a closable discharge aperture.

11. A container according to claim 7, characterized in that the panel, at its side edges adjacent the edges of the legs, is extended to incorporate pivoting panel sections which are secured to the respective external surfaces of the legs, each panel and the web being provided with a folding line halfway between the two legs and the web serving as bottom wall.

12. A container according to any one of claim 11, characterized in that a panel is extended along its longitudinal edge which is adjacent a lateral edge of the web in the filled condition of the container, to incorporate a pivoting strip member which can be pivoted against the web in the filled condition of the container.

13. A container according to any one of claim 7, characterized in that a stiff rod-shaped element is arranged in each corner formed by a leg and a panel, which element extends throughout the height of the container and preferably has a triangular cross-section.

14. A container according to claim 5, characterized in that the strip-shaped member forms the wall of a trough of stiff material, such as wood, which trough, viewed in horizontal cross-section, has an inner contour of a length and width at least equal to the length of the web and the largest width of the legs of the U-shaped stiffening member.

15. A container according to claim 14, characterized in that the trough is affixed onto a pallet.

16. A container according to any one of claims 1–3, characterized in that for attaching the enveloping member with inner member to the U-shaped stiffening member, this stiffening member is inserted in two slots provided on opposite sides of a pallet, the bottom face of each slot being in alignment with the bearing surface of the pallet and the slots being positioned relative to each other in such a manner that the legs of the U-shaped stiffening member can be brought into a position extending vertically relative to the bearing surface of the pallet.

* * * * *